United States Patent [19]

Naka et al.

[11] Patent Number: 4,922,670

[45] Date of Patent: May 8, 1990

[54] FREE ACCESS FLOOR AND METHOD OF CONSTRUCTING THE SAME

[75] Inventors: Hiromasa Naka; Norio Nakamura, both of Tokyo; Takehiko Okushima, Saitama; Takao Okumura, Saitama; Tatsuo Shoji, Saitama, all of Japan

[73] Assignee: Naka Technical Laboratory, Tokyo, Japan

[21] Appl. No.: 302,319

[22] Filed: Jan. 27, 1989

[51] Int. Cl.[5] ..... E04F 15/024

[52] U.S. Cl. ..... 52/126.6; 52/263; 52/747

[58] Field of Search ..... 52/263, 126.3, 741, 52/747, 126.6; 174/48

[56] References Cited

U.S. PATENT DOCUMENTS

| | | | |
|---|---|---|---|
| 3,318,057 | 5/1967 | Norsworthy | 52/126.6 |
| 3,378,972 | 4/1968 | Stanley | 52/704 |
| 3,470,663 | 10/1969 | Tate | 52/126.6 |
| 4,085,557 | 4/1978 | Tharp | 52/126.6 X |
| 4,277,923 | 7/1981 | Rebentisch | 52/126.6 |
| 4,438,610 | 3/1984 | Fifer | 52/263 |
| 4,578,910 | 4/1986 | Germeroth | 52/126.6 X |
| 4,630,417 | 12/1986 | Collier | 52/263 |
| 4,685,258 | 4/1987 | Zuk | 52/126.6 |
| 4,780,571 | 10/1988 | Huang | 174/48 |

FOREIGN PATENT DOCUMENTS

| | | |
|---|---|---|
| 52-30120 | 7/1977 | Japan . |
| 56-38110 | 9/1981 | Japan . |
| 56-50047 | 11/1981 | Japan . |
| 57-33418 | 7/1982 | Japan . |
| 61-17147 | 5/1986 | Japan . |
| 63-184654 | 7/1988 | Japan . |
| 63-184655 | 7/1988 | Japan . |

*Primary Examiner*—John E. Murtagh

*Attorney, Agent, or Firm*—Wenderoth, Lind & Ponack

[57] ABSTRACT

The present invention relates to a double flooring structure which may be used to constitute the floor of a computer room or the like in a building. The double flooring structure has excellent constructibility, high earthquake resistance, a wide underfloor space and excellent resistant to deformation under load. The double flooring structure of the present invention comprises bases secured to a floor surface, columnar leg members pivotally standing on the bases, respectively, stringers each stretched between a pair of adjacent columnar leg members, floor panels supported on the stringers, and fastening means for securing the floor panels to the columnar leg members. The pivot point of each columnar leg member is disposed near the floor surface. When the floor panels are secured to the columnar leg members by the fastening means, the columnar leg members, the stringers and the floor panels constitute in combination one rigid body. Accordingly, a load which is applied to each floor panel is dispersed effectively and efficiently. If a lateral load is applied to the double flooring structure of the present invention, the columnar leg members are urged to pivot. However, since the pivot point of each columnar leg member is disposed near the floor surface, it is possible to minimize the bending moment that acts on that portion of each base which is bonded to the floor surface.

11 Claims, 10 Drawing Sheets

FREE ACCESS FLOOR AND METHOD OF CONSTRUCTING THE SAME

BACKGROUND OF THE INVENTION (1) Field of the Invention

The present invention relates to a double flooring structure which may be used to constitute the floor of a computer room or the like in a building, that is, a free access floor. More particularly, the present invention pertains to a free access floor which is defined by a multitiplicity of floor panels laid above the floor surface of a building so that a space for accommodating cables, ventilating ducts and the like is ensured between the free access floor constituted by floor panels and the floor surface. The present invention is also concerned with a method of constructing said free access floor.

(2) Description of the Prior Art

In general, a free access floor which may be used for a computer room or the like is laid at a level 500 mm or more from the floor surface of the building. A large number of cables are connected to a computer and it is also necessary to install ducts or the like, for example, ventilating ducts of an air conditioner, and therefore a sufficiently large space to accommodate such cables and ducts must be ensured under the floor panels that constitute the free access floor. In order to ensure a sufficiently large underfloor space, floor panels used to constitute a free access floor are laid in such a manner that support legs, which are members separate from the floor panels, are stood on a floor surface made, for example, of concrete, and the floor panels are supported on the upper ends of the support legs.

FIG. 1 shows a conventional free access floor of the type in which floor panels are supported by means of support legs which are members separate from the floor panels. In the case of the illustrated free access floor, bases 2 are firmly secured by means, for example, of an adhesive at predetermined positions, respectively, on a floor surface 1 of a building, and the lower ends of support legs 3 are secured to the respective bases 2 by means, for example, of welding. A height adjusting plate 4 is brought into thread engagement with the upper end portion of each of the support legs 3 standing on the respective bases 2. A plurality of floor panels 5 are supported on the height adjusting plates 4 in such a manner that the floor panels 5 are disposed adjacent to each other. The floor surface 6 of the free access floor is defined by the upper surfaces of the floor panels 5.

Since in the above-described free access floor the support legs 3 are firmly secured to the floor surface 1 through the bases 2, when lateral force is applied to the free access floor due to an earthquake or the like, the bending moment that acts on the free access floor reaches a maximum at the lower end of each support leg 3, as shown in FIG. 2. In other words, the earthquake resistance of the free access floor depends on the bond strength between the floor surface 1 and the bases 2. Therefore, it is necessary in order to obtain satisfactory earthquake resistance to interpose a reinforcing rod 7 between the floor surface 1 and the intermediate portion of each support leg 3 to thereby prevent collapse of the support legs 3, as shown in FIG. 1.

It should be noted that, although each pair of adjacent height adjusting plates 4 are connected together through a stringer 8 in the prior art shown in FIG. 1, the stringers need not be resistant to a large bending moment since the bending moment that acts at the upper end of each height adjusting plate 4 is relatively small, as shown in FIG. 2. Therefore, the stringers 8 are attached to the height adjusting plates 4 by relatively simple means such as a fitting.

Thus, in the above-described conventional free access floor the bases 2 are secured to the floor surface 1 by means of an adhesive so that the free access floor is resistant to the moment that acts so as to collapse it by virtue of the bond strength of the adhesive. Therefore, the prior art involves the following problems. The bond strength of an adhesive is likely to change in accordance with bonding conditions, for example, the surface condition of the floor surface 1, and the bond strength lowers with age. Accordingly, a relatively large bond area is needed in order to obtain a predetermined level of aseismatic performance, resulting in an increase in the size of the bases 2. It is therefore difficult to improve the constructibility of the free access floor.

Since the foregoing free access floor needs the reinforcing rods 7, the number of steps required to construct the free access floor increases and, since the reinforcing rods 7 are disposed on the floor surface 1 at predetermined regular spacings, the space under the floor cannot be utilized to the fullest.

Further, although each pair of adjacent support legs 3 are connected together through a stringer 8, each stringer 8 and the corresponding height adjusting plates 4 are connected together simply by a fitting or the like and there is therefore a clearance between each stringer 8 and a height adjusting plate 4 fitted thereto. Accordingly, a load that is applied to one support leg 3 cannot be transmitted to another support leg 3 which is adjacent to it through a stringer 8 so that the load is distributed to a large number of support legs 3. For this reason, when a heavy object is placed on the free access floor, the load is concentrated on a relatively small number of support legs 3 and therefore these support legs 3 must be reinforced. In such a case, there are two different kinds of support legs 3 in the construction of such a free access floor, that is, those which need reinforcement and those which do not, and therefore the construction cannot be performed at high efficiency. In other words, the constructibility of the prior art floor has heretofore been unsatisfactory.

SUMMARY OF THE INVENTION

It is an object of the present invention to provide a free access floor having superior constructibility.

It is another object of the present invention to provide a free access floor which has high resistance to earthquakes and which provides a large underfloor space.

It is still another object of the present invention to provide a free access floor which has high resistance to deformation under load.

It is a further object of the present invention to provide a free access floor which is designed so that no large bending moment will act on a base which is secured to the floor surface to support the lower end of each support leg.

It is a still further object of the present invention to provide a free access floor which is designed so that a load which is applied thereto can be effectively distributed to a plurality of support legs through stringers.

To these ends, the present invention provides a free access floor having the following arrangement.

Support legs which are members separate from floor panels are stood at predetermined regular spacings on a floor surface where a double flooring is to be formed. Each support leg comprises a base secured to the floor surface by means, for example, of an adhesive and a columnar leg member pivotally supported on the base. The columnar leg member is pivotally stood on the base with the lower end portion thereof being engaged with the base. It is preferable to dispose the pivot point of the columnar leg member as close to the floor surface where the base is secured as possible. Then, a stringer is stretched between the upper ends of the columnar leg members of each pair of adjacent support legs. The stringer and the upper end of each columnar leg member must be firmly connected so that no relative displacement will occur therebetween. The number of stringers which are connected to the upper end of each columnar leg member depends on the configuration of floor panels used. This is because in the free access floor of the present invention the bottom portion (or a portion in the vicinity thereof) of each floor panel is directly supported by a stringer. For example, in the case where square floor panels are used and each of the four sides of each square floor panel is supported by a stringer, four stringers are connected to the upper end of each columnar leg member. Upon completion of the installation of stringers, floor panels are laid in such a manner that the panels are directly supported by the stringers. Then, the floor panels are secured to the support legs by use of fixing means such as panel holders.

In the free access floor according to the present invention having the described arrangement, the columnar leg members of the support legs, the stringers, the floor panels and the floor panel fixing means constitute in combination one rigid body and this rigid body is supported on a plurality of bases. In this case, for each pair of adjacent bases, an L-shaped rigid frame is supported on these bases.

Since in the free access floor of the present invention the structural members which are above the bases constitute in combination one rigid body, a load which is applied to each floor panel is dispersed highly efficiently. Thus, the free access floor has excellent resistance to deformation under load. Since the pivot point of the columnar leg member of each support leg is disposed near the floor surface, no large bending moment acts on that portion of each base which is bonded to the floor surface. Accordingly, it is possible to impart high earthquake resistance to the bonded portion of each base without the need to increase the size of the bases. Further, when a collapsing moment acts on the free access floor due to, for example, an earthquake, a relatively large bending moment acts on the upper end portion of the columnar leg member of each support leg, but the free access floor of the present invention is sufficiently resistant to this bending moment since the structural members above the bases constitute in combination one rigid body. In addition, since the free access floor of the present invention is capable of exhibiting sufficiently high earthquake resistance without the need to use support leg reinforcing rods, a large underfloor space can be ensured and excellent constructibility is provided.

The above and other objects, features and advantages of the present invention will become more apparent from the following description of the preferred embodiments thereof, taken in conjunction with the accompanying drawings.

Figure 1:
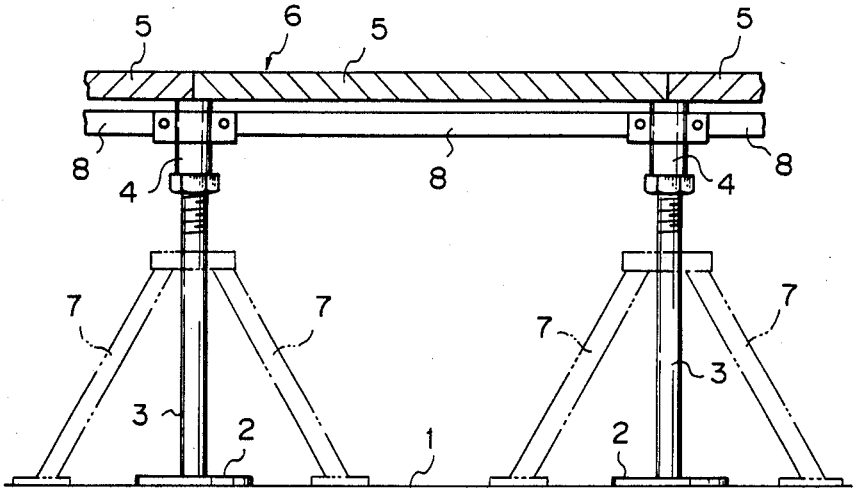
Fig. 1 PRIOR ART
FIG. 1 is a fragmentary side view of a conventional free access floor.
Figure 2:
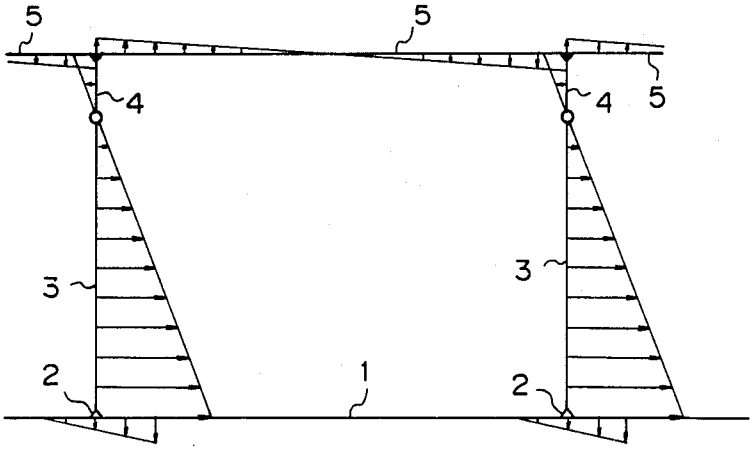
Fig. 2 PRIOR ART
FIG. 2 shows bending moments that act when lateral force is applied to the free access floor having no support legs in FIG. 1.

DETAILED DESCRIPTION OF THE INVENTION (1) First Embodiment

A first embodiment of the present invention is shown in FIGS. 3 to 10.

The free access floor 10 comprises a plurality of support legs 12 standing on a floor surface 11 at predetermined regular spacings, a plurality of stringers 13 each extending between the upper ends of a pair of adjacent support legs 12, a plurality of floor panels 14 each supported at a desired level above the floor surface 11 in such a manner that the edge portions of the floor panels 14 are supported by the stringers 13, and panel holders 15 which are securing means for securing the four corners of each floor panel 14 to the upper ends of the corresponding support legs 12.

Each support leg 12 comprises a base 16 which is rigidly secured to the floor surface 11 by means, for example, of an adhesive, and a columnar leg member 17 which is pivotally supported on the base 16.

The base 16 has a square base plate **16*a* which has a threaded member 16*b* rigidly secured thereto by means, for example, of welding. The threaded member 16*b* has an external thread portion 16*c* projecting upward from the base plate 16*a* and a height adjusting nut 16*d* is screwed on the external thread portion 16*c*. The height adjusting nut 16*d* has a shoulder portion 16*e* and an annular groove 16*f* formed in the peripheral surface thereof, the shoulder portion 16***e* being reduced in diameter at the upper side thereof, the annular groove 16*f* being disposed above the shoulder portion 16*e*. It should be noted that the reference numeral 16*g* in FIG. 4 denotes a multiplicity of small bores which are formed in the base plate 16*a*. When the base 16 is secured to the floor surface 11 by means of an adhesive, the adhesive enters the small bores 16*g* and sets therein, thereby fixing the base 16 even more firmly and thus increasing the bond strength.

Figure 5:
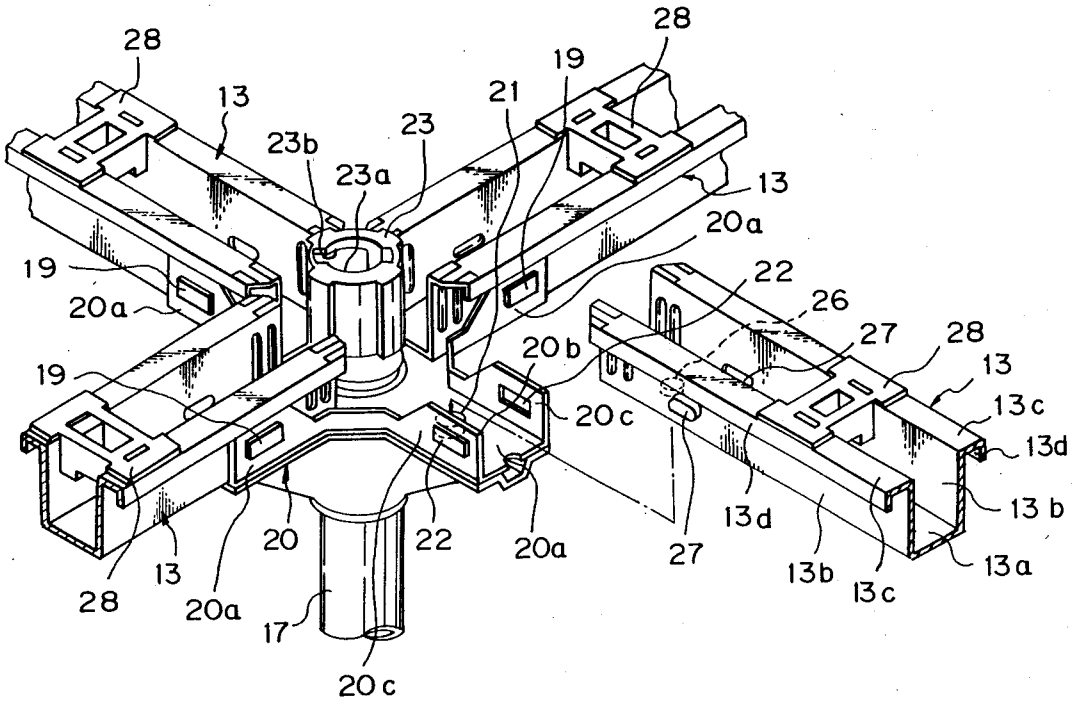
FIG. 5 is an exploded perspective view of the upper end portion of one support leg, which shows the way in which each support leg of the free access floor shown in FIG. 3 is engaged with stringers.
Figure 6:
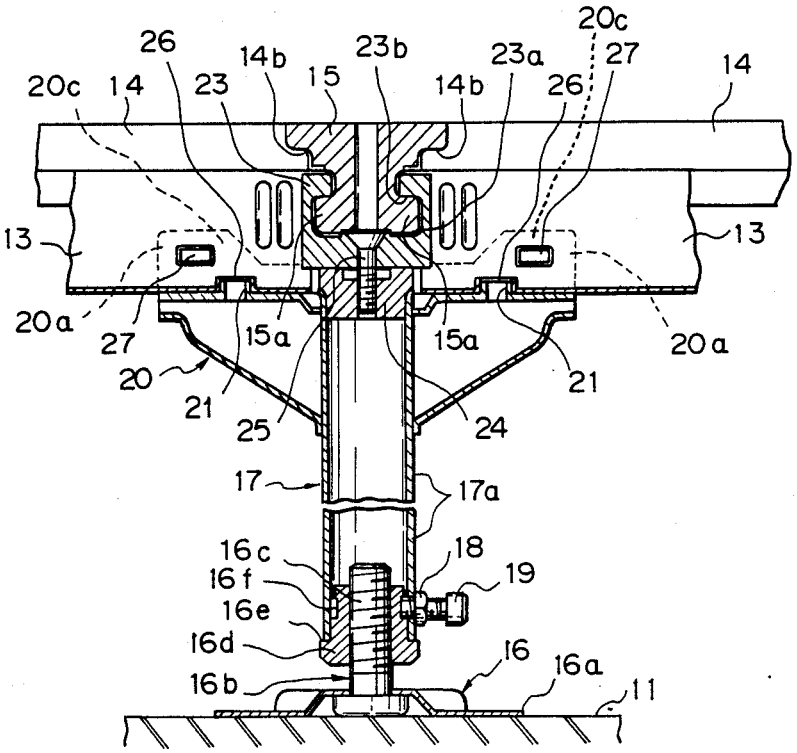
FIG. 6 is a fragmentary vertical sectional view of the free access floor shown in FIG. 3, which shows one support leg thereof associated therewith.

The columnar leg member 17 is a cylindrical member 17*a* (see FIG. 6). The nut 18 is rigidly secured to the lower end portion of the cylindrical member 17*a* by means, for example, welding, and a bolt 10 is threaded into the nut 18 so that the nut 18 is prevented from disengaging from the cylindrical member 17*a*. A stringer retainer 20 is rigidly secured to the upper end portion of the cylindrical member 17*a*. The stringer retainer 20 is provided with four grooves 20*a* which extend horizontally at equal angular spacings, the upper side of each groove 20*a* being open. As shown in FIG. 5, each of the grooves 20*a* formed in the stringer retainer 20 is defined by a bottom portion 20*b* and a pair of side wall portions 20*c* which stand on both sides, respectively, of the bottom portion 20*b*. A projection 21 is formed on the bottom portion 20*b* by burring (see FIG. 6). The side wall portions 20*c* are respectively provided with recesses 22 which face each other. In addition, a panel holder receiving member 23 is disposed in the center of the upper side of the stringer retainer 20. The panel holder receiving member 23 is secured through a bolt 25 to a top member 24 which is secured to the upper end of the columnar leg member 17 by means, for example, of welding. The panel holder receiving member 23 is provided with an engagement hole 23*a* which opens upward. An inclined surface 23*b* is formed on the inner wall of the engagement hole 23*a*. A projecting portion 15*a* that is formed on the panel holder 15 is engaged with the surface 23*b*, thereby enabling the floor panel 14 to be secured in a single and simple operation.

Each stringer 13 is formed by pressing a steel plate. The stringer 13 has a bottom portion 13*a*, side wall portions 13*b* which stand upwardly on both sides, respectively, of the bottom portion 13*a*, outwardly extending horizontal edge portions 13*c* which are continuous with the respective side wall portions 13*b*, and downwardly extending end edge portions 13*d* which are continuous with the respective horizontal edge portions 13*c*. A bore 26 is formed in each axial end portion of the bottom portion 13*a* of the stringer 13 by burring so that the projection 21 that is formed in the groove 20*a* of the stringer retainer 20 is fitted into the bore 26 when the stringer 13 is installed. Projections 27 are formed on the side wall portions 13, respectively, at each axial end of the stringer 13 so that the projections 27 are respectively fitted into the recesses 22 in the side wall portions 20*c* of the stringer retainer 20 when the stringer 13 is installed. A panel retaining member 28 which is made of a synthetic resin material is mounted on the stringer 13 in such a manner that the panel retaining member 28 extends between the horizontal edge portions 13*c*.

Figure 8:
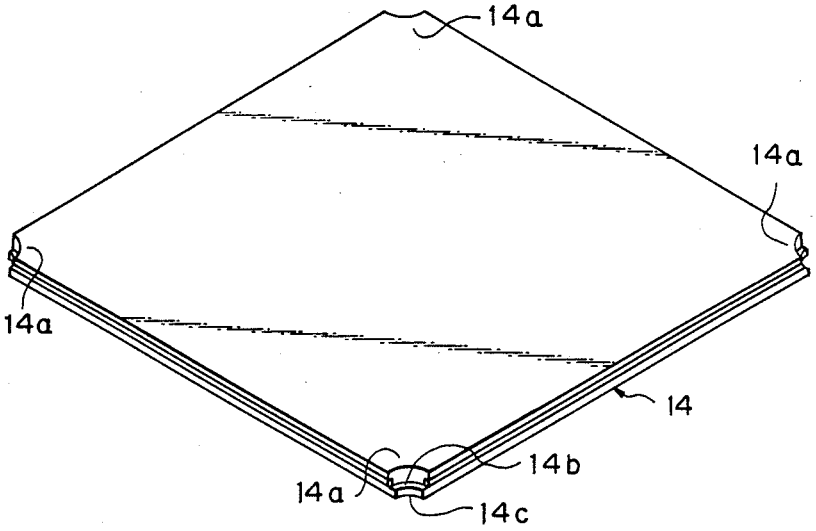
FIG. 8 is a perspective view of one example of floor panels used to form the free access floor of the present invention.
Figure 9:
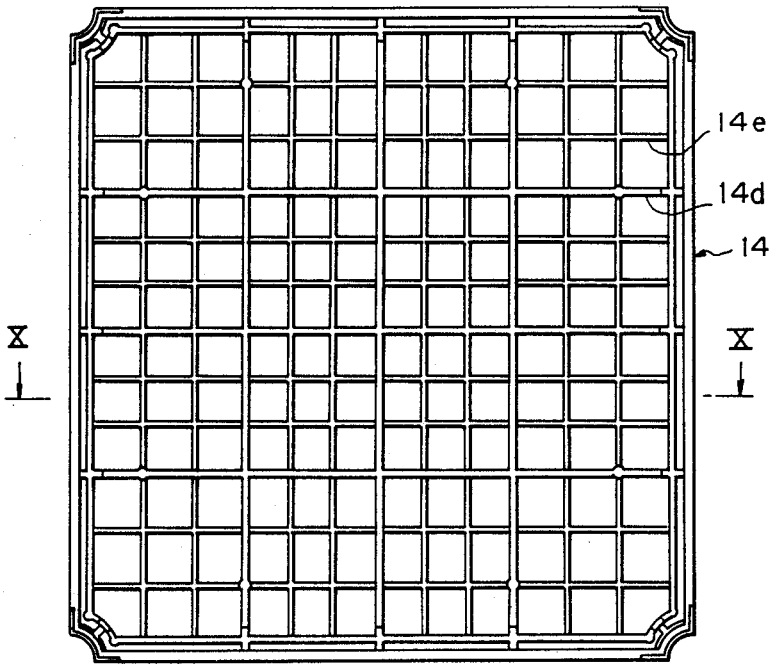
FIG. 9 is a rear view of the floor panel shown in FIG. 8.
Figure 10:
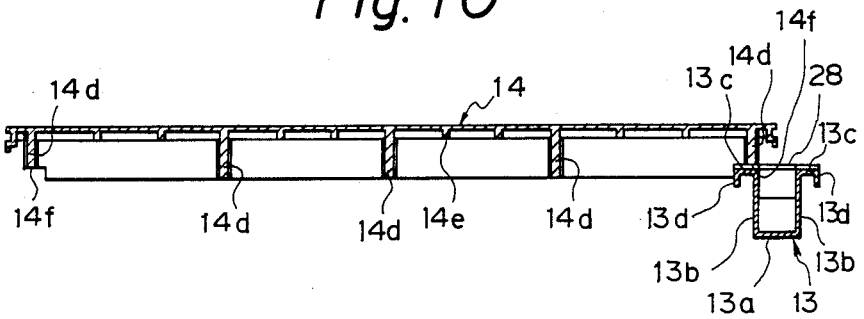
FIG. 10 is a sectional view taken along the line X—X of FIG. 9.

Each floor panel 14 is formed in a square shape by die casting of aluminum, as shown in FIGS. 8 to 10. A quadrantal step 14*b* and notch 14*c* are provided in each corner 14*a* of the floor panel 14. In addition, relatively deep reinforcing ribs 14*d* and relatively shallow reinforcing ribs 14*e* are formed in a lattice shape on the reverse surface of the floor panel 14. Among the relatively deep reinforcing ribs 14*d*, those which are disposed at the four sides of the floor panel 14 are provided with step portions 14*f*, respectively, so that, when the floor panel 14 is laid, the panel retaining member 28 which is mounted on each stringer 13 is engaged with the corresponding step portion 14*f*. It should be noted that the floor panel 14 may be formed by pressing a steel plate or the like.

The free access floor 10 having the foregoing arrangement is constructed by the following procedure.

Bases 16 are first temporarily fixed to predetermined positions on the floor surface 11 by means of an adhesive. The term "temporary fixing" is herein employed to mean a state wherein the adhesive has not yet become completely set so that the position of each base 16 secured to the floor surface 11 can be corrected to a certain extent. Columnar leg members 17 are secured to the bases 16, respectively, in such a manner that the lower end portion of each columnar leg member 17 is engaged with the shoulder portion 16*e* of the height adjusting nut 16*d*. The columnar leg member 17 is prevented from disengaging from the base 16 by advancing the distal end portion of the bolt 19 into the annular groove 16*f* provided in the periphery of the height adjusting nut 16*d*. Since the bolt 19 only functions as a means for preventing the columnar leg member 17 from disengaging from the base 16. the columnar leg member 17 is capable of pivoting about the lower end portion thereof within a certain range of angles. Upon completion of temporary fixing of a pair of adjacent bases 16, a stringer 13 is placed between the stringer retainers 20 of the bases 16. During the operation of installing the stringer 13, the height adjusting nuts 16*d* are, if necessary, rotated to adjust the height of the stringer retainers 20. The stringer 13 is installed with two axial end portions thereof being fitted into the respective grooves 20*a* in the stringer retainers 20. At this time, the projection 21 that is formed on the bottom portion 20*b* of each stringer retainer 20 is fitted into the corresponding bore 26 provided in the stringer 13 and, at the same time, the projections 27 that are formed on the side wall portions 13 of the stringer 13 are fitted into the corresponding recesses 22 formed in the side wall portions 20*c* of the stringer retainers 20. Thus, since the stringer 13 is positioned so that it will not move relative to the stringer retainers 20, when a stringer 13 has been installed in position, the spacing between a pair of adjacent support legs 12 is determined. In other words, the stringer 13 functions as a kind of jig for determining the relative positions of a pair of adjacent support legs 12. Accordingly, if stringers 13 are successively installed in the temporary fixing state, it is possible to set one of each pair of adjacent support legs 12 at a predetermined position on the basis of the position of the other support leg 12 which has already been positioned, without the need to use a special jig. In this way, temporary fixing of a support leg 12 and installation of a stringer 13 are alternately conducted to thereby stand a predetermined number of support legs 12 on the floor surface 11.

Figure 3:
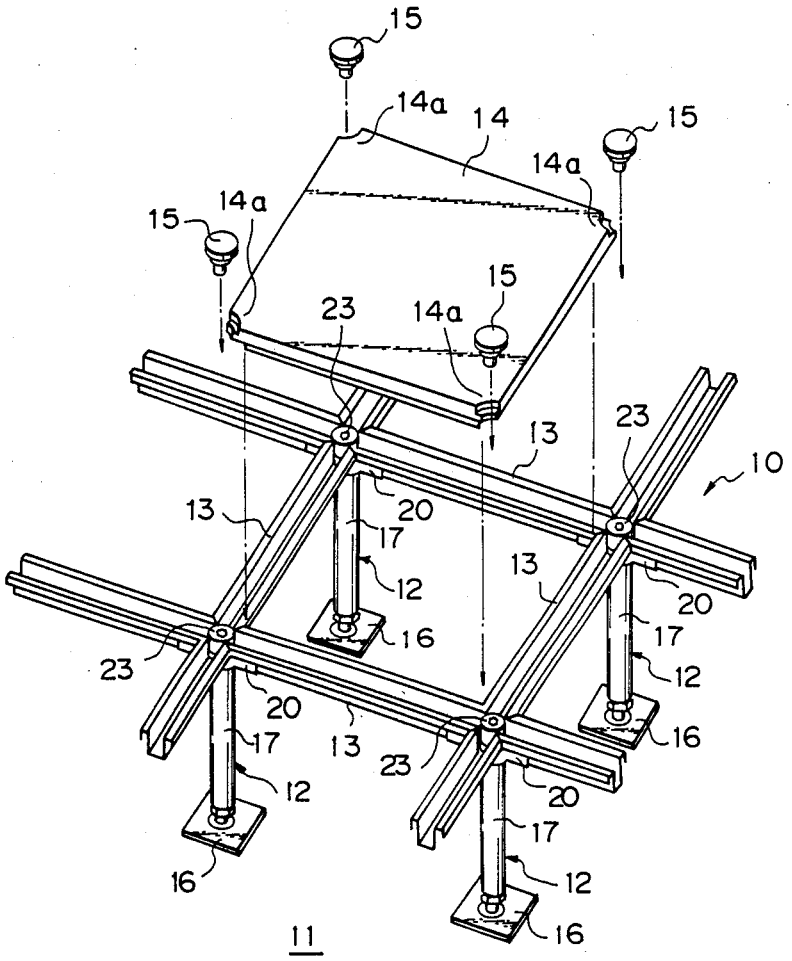
FIG. 3 is an exploded perspective view of a first embodiment of the free access floor according to the present invention.
Figure 4:
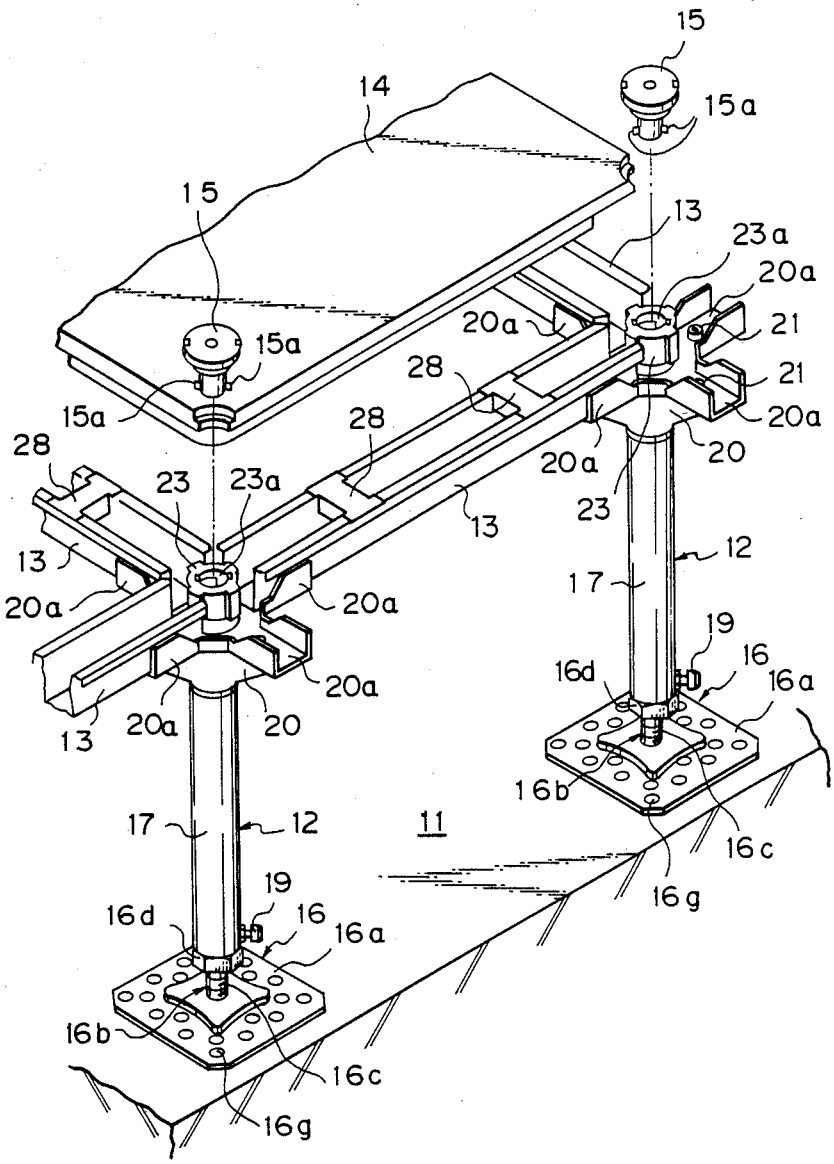
FIG. 4 is an exploded enlarged perspective view of an essential part of the free access floor shown in FIG. 3.
Figure 7:
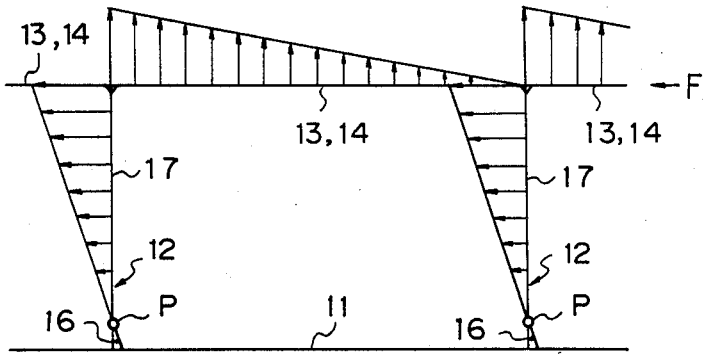
FIG. 7 shows bending moments that act when lateral force is applied to the free access floor shown in FIG. 3.

Upon completion of the installation of a necessary number of support legs 12, floor panels 14 are successively laid. As shown in FIG. 3, each floor panel 14 is disposed in such a manner that the four edges thereof extend along the horizontal edge portions 13*c* of four stringers 13, respectively, and the underside of each edge of the floor panel 14 is supported by the panel retaining member 28 mounted on the corresponding stringer 13. In this way, floor panels 14 are successively laid on the support legs 12. Upon completion of laying of a predetermined number of floor panels 14, the four corners 14*a* of each floor panel 14 are secured to the corresponding panel holder receiving members 23 by means of panel holders 15. The respective corners 14*a* of four adjacent floor panels 14 are concentrated on the panel holder retaining member 23 that is secured to the upper end of each support leg 12, so that an annular step is formed by a combination of four steps 14*b* and a panel holder insertion bore is defined by a combination of four notches 14*c*. Each panel holder 15 is inserted into the panel holder insertion bore from the upper side of the floor panel 14 in such a manner that the panel holder 15 is engaged with the annular step, and the projecting portion 15*a* of the panel holder 15 is inserted into the engagement hole 23*a* in the panel holder receiving member 23. After having the projecting portion 15*a* inserted into the engagement hole 23*a*, the panel holder 15 is rotated through about 90 degrees with the projecting portion 15*a* in engagement with the surface 23*b* formed within the engagement hole 23*a*. Thus, each panel holder 15 presses the steps 14*b* of the four floor panels 14 toward the panel holder receiving member 23 to thereby secure these floor panels 14. At this time, the stringers 13 are firmly clamped between the floor panels 14 and the stringer retainers 20. Accordingly, when securing of all the floor panels 14 has been completed, among the structural members that constitute in combination the free access floor 10, those which are above the bases 16, that is, the columnar leg portions 17, the stringers 13, the floor panels 14, the panel holders 15 and the panel holder receiving members 23, constitute in combination one rigid body. Noting, in particular, a pair of adjacent support legs 12, an L-shaped rigid frame is constituted by a combination of the columnar leg members 17 of the support legs 12, a stringer 13 stretched between the columnar leg members 17, a floor panel 14 placed on the stringer 13, panel holders 15 securing the floor panel 14 and the panel holder receiving members 23 engaged with the panel holders 15. FIG. 7 shows bending moments that act when a lateral load is applied to the free access floor 10 of the present invention. In the figure, a L-shaped rigid frame is constituted by a combination of a pair of columnar leg members 17, a stringer 13 and a floor panel 14. This L-shaped rigid frame is supported on bases 16 through pin joints P which serve as pivot points. Since the pin joints P are disposed near the floor surface 11, if a lateral load is applied to such an L-shaped rigid frame, bending moments act as shown in FIG. 7. As will be clear from the figure, since each pin joint P is disposed near the floor surface 11, only a small bending moment acts on that portion of each base 16 which is bonded to the floor surface 11. Accordingly, it is possible to impart high earthquake resistance to the bonded portion of each base 16 without the need to increase the bond strength of the base 16 with respect to the floor surface 11. On the other hand, if a collapsing moment acts on a support leg 12, a relatively large bending moment acts on the upper end portion of the columnar leg portion 17. In the free access floor according to the present invention, however, the structural members above the bases 16 constitute in combination one rigid body, as described above. Therefore, the free access floor of the present invention has satisfactorily high earthquake resistance with respect to the relatively large bending moment acting on the upper end portion of each columnar leg member 18. Further, since the structural members above the bases 16 constitute in combination one rigid body in the free access floor of the present invention, the weight of an article which is placed on the free access floor is effectively dispersed. Therefore, the free access floor according to the present invention is also superior in its resistance to deformation under vertical load.

(2)Second Embodiment

Figure 11:
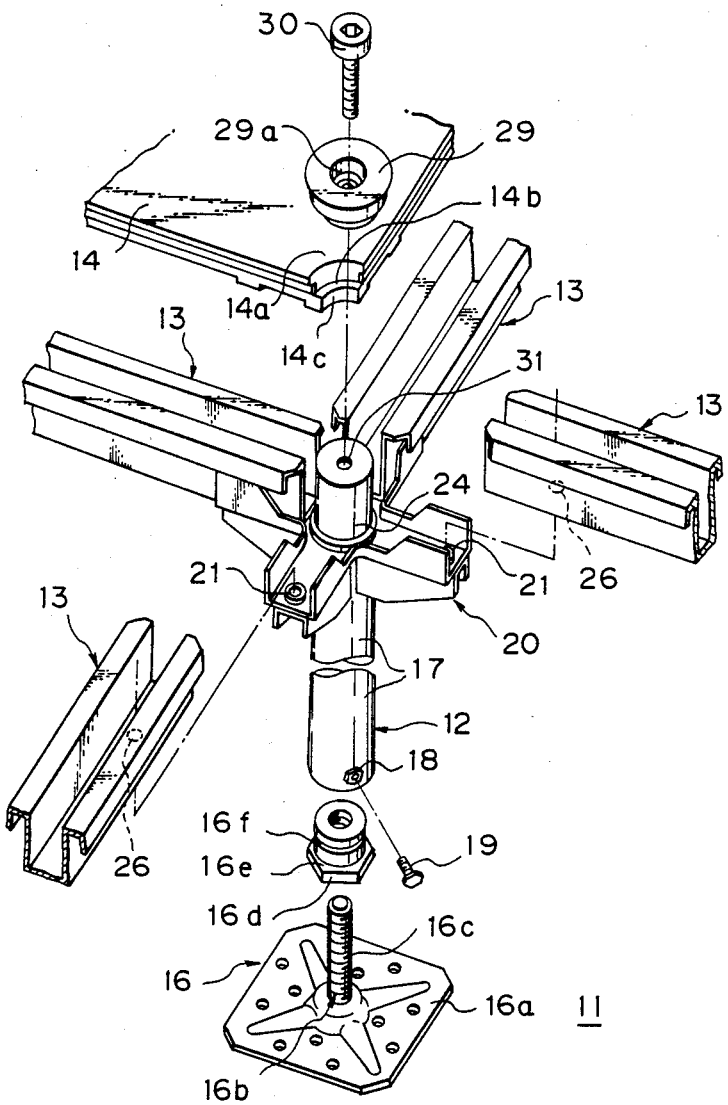
FIG. 11 is an exploded perspective view showing an essential part of a second embodiment of the free access floor according to the present invention.
Figure 12:
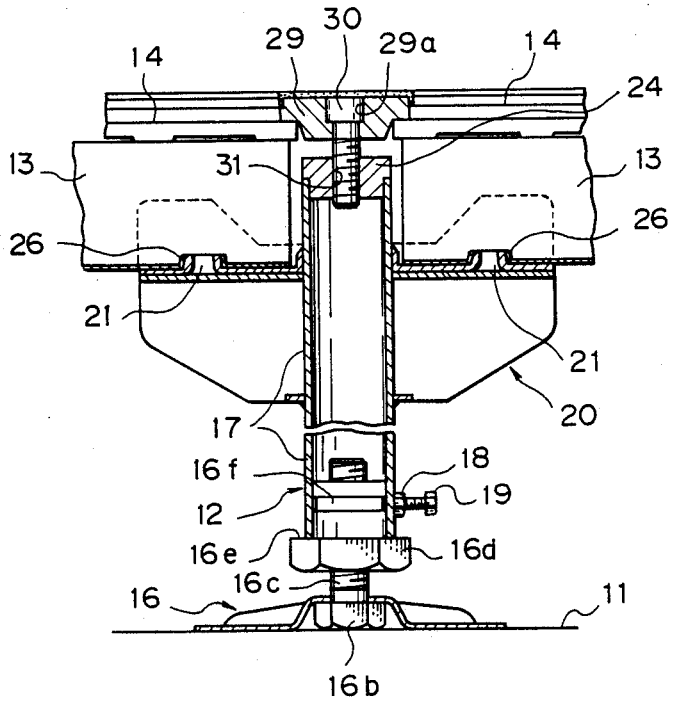
FIG. 12 is a fragmentary vertical sectional view of the free access floor shown in FIG. 11 in its assembled state, which shows one support leg thereof and elements associated therewith.

FIGS. 11 and 12 show in combination a second embodiment of the present invention. In these figures, the same reference numerals as those used in FIGS. 1 to 10 denote the same constituent members as those of the first embodiment.

The feature of this embodiment resides in that bolt fixing type panel holders 29 are employed in place of the panel holders 15 used in the first embodiment. Each panel holder 29 has a bolt receiving bore 29*a* formed in the center thereof. A bolt 30 is inserted through the bolt receiving bore 29*a*. On the other hand, the top member 24 that is secured to the upper end of each columnar leg member 17 by means, for example, of welding has a threaded bore 31 formed in the center thereof. The bolt 30 that is inserted through the bolt receiving bore 30 provided in the panel holder 29 is screwed into the threaded bore 31 provided in the top member 24. Thus, the panel holder 29 presses the respective corners 14*a* of four adjacent floor panels 14 toward the top member 24 to thereby secure these floor panels 14. To remove the floor panels 14, it is only necessary to remove the bolt 30 from the threaded bore 31 in the top member 24 to thereby cancel the pressing force applied to the floor panels 14 from the panel holder 29. The other arrangements of this embodiment are the same as those of the first embodiment.

(3) Third Embodiment

Figure 13:
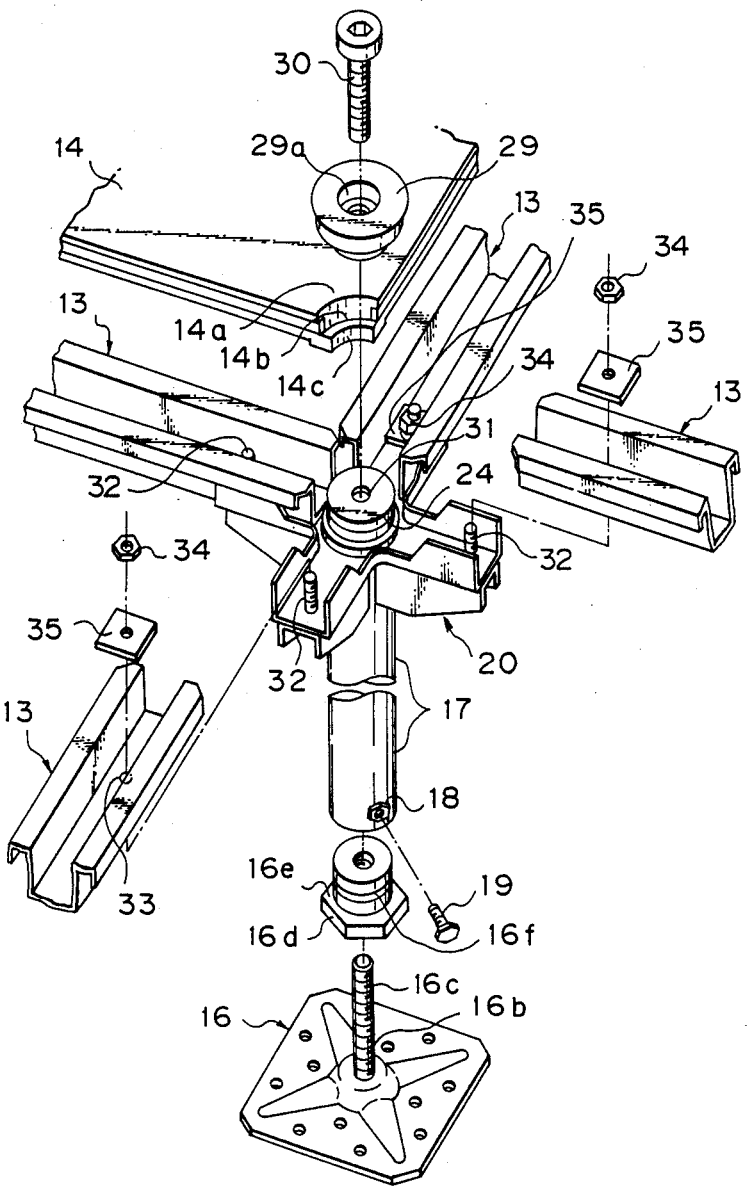
FIG. 13 is an exploded perspective view of a third embodiment of the free access floor according to the present invention.

FIG. 13 shows a third embodiment of the present invention. In this figure, the same reference numerals as those used in FIGS. 1 to 12 denote the same constituent members as those of the first and second embodiments.

The feature of the third embodiment resides in that a combination of a bolt 32 standing on each stringer retainer 20, a bolt receiving bore 33 formed in the bottom portion 13*a* of each stringer 13, a nut 34 which is screwed onto the bolt 32, and a washer 35 interposed between the nut 34 and the bottom portion 13*a* of the stringer 13 is employed as a means for preventing relative displacement between each stringer 13 and the corresponding stringer retainer 20. More specifically, each stringer 13 is attached to the corresponding stringer retainer 20 through a bolt 32 inserted through the bolt receiving bore 33 and, after the washer 35 is fitted on the bolt 35, the nut 34 is screwed onto the bolt 32 to fasten the stringer 13 to the stringer retainer 20. Accordingly, unlike the first and second embodiments, the third embodiment enables each stringer 13 to be secured to the corresponding stringer retainer 20 without the need to press a floor panel 14 against the stringer 13 by means of a panel holder 29. The other arrangements of this embodiment are the same as those of the second embodiment.

As has been described with respect to the first to third embodiments, it is possible according to the present invention to effectively disperse a load applied to each floor panel constituting a free access floor since the structural members above the bases constitute in combination one rigid body. It is therefore possible to provide a free access floor having satisfactorily high resistance to deformation under load.

Since in the free access floor of the present invention the pivot points of the support legs for supporting floor panels are disposed near the floor surface, no large bending moment acts on that portion of each base which is bonded to the floor surface. Accordingly, it is possible to increase the earthquake resistance without the need to provide reinforcing rods on the support legs nor increase the size of bases in order to enlarge the bond area. Thus, it is possible to solve the problem that the space under the free access floor is reduced by the existence of reinforcing rods and, therefore, a free access floor having a large underfloor space is provided. In addition, since it is unnecessary to increase the size of bases, handling of the bases is facilitated.

Further, in the construction of the free access floor according to the present invention, a stringer that connects together the upper end portions of each pair of adjacent support legs functions as a jig for positioning the support legs and this enables realization of a free access floor having excellent constructibility in cooperation with the advantages that no reinforcing rods are needed and it is unnecessary to increase the size of bases.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A free access floor comprising:

a plurality of bases secured to a surface where said free access floor is to be built, each of said bases having a base plate, a threaded member standing on said base plate, and a height adjusting nut screwed on said threaded member;

a plurality of column members supported on said bases, respectively, and each being pivotally engaged at the lower end portion thereof with said height adjusting nut and thereby supported so that each of said column members has a pivot point near said free access floor building surface;

a plurality of stringers each connected between a pair of adjacent column members in such a manner that said stringer is not displaced relative to said column members, said stringers extending substantially horizontally;

a plurality of floor panels supported on said stringers; and fastening means for securing said floor panels to said column members;

said height adjusting nut having a shoulder portion and an annular groove formed in the peripheral surface thereof, said shoulder portion being reduced in diameter at the upper side thereof, said groove being disposed above said shoulder portion, so that the lower end portion of said column member is engaged with said shoulder portion, and a disengagement preventing bolt attached to said column member, said bolt being radially movable toward and away from said column member, the distal end portion of said bolt being fitted into said annular groove.

2. A free access floor according to claim 1, wherein said floor panels have a square configuration in plan view, said bases being disposed on said free access floor building surface at predetermined regular spacings in both lengthwise and breadthwise directions, each of said stringers supporting the underside of one of the four edge portions of one of said floor panels, and said fastening means securing one corner of said floor panel to the upper end of one of said column members.

3. A free access floor according to claim 1 or 2, wherein said column members are cylindrical members.

4. A method of constructing a free access floor comprising the steps of:

fixing one support leg serving as a reference on a free access floor building surface;

temporarily fixing another support leg at a position which is a predetermined distance away from said first support leg;

placing a stringer between the two support legs in such a manner that the ends of said stringers are respectively disposed in a predetermined position in a corresponding stringer retainer attached to each of said support legs, and correcting, if necessary, the position of said second support leg and further adjusting, if necessary, the position of said second support leg;

arranging floor panels on said stringers in such a manner that the side portions of said floor panel are laid on panel retaining members attached to said stringers and respectively extend along the horizontal edge portion of the corresponding stringer; and securing said floor panels and said stringers by panel holders in such a manner that said floor panels and said stringers are pressed between said panel holders and said support legs.

5. A free access floor according to claim 1, further comprising a stringer retainer secured to the upper end of each of said column members, said stringer retainer being provided with a horizontal groove the upper side of which is open, said groove having a bottom portion extending in the direction in which the corresponding stringer extends and a pair of upright side wall portions on both sides, respectively, of said bottom portion, the bottom portion of said groove in said stringer retainer having a projection, and the bottom portion of said stringer having a bore, so that said projection on said stringer retainer is fitted into said bore in said stringer when installed; and said fastening means having a panel holder receiving member attached to the upper end of each of said column members and a panel holder brought into contact with a floor panel, said panel holder being detachably engaged with said panel holder receiving member, thereby pressing said floor panel toward said panel holder receiving member and thus securing said floor panel.

6. A free access floor comprising:

a plurality of bases secured to a surface where said free access floor is to be built;

a plurality of column members supported on said bases, respectively, and each having a pivot point near said surface;

a plurality of stringers each connected between a pair of adjacent column members in such a manner that said stringer is not displaced relative to said column members, said stringers extending substantially horizontally;

a plurality of floor panels supported on said stringers;

fastening means for securing said floor panels to said column members;

a stringer retainer being secured to the upper end of each of said column members, each said stringer retainer being provided with a horizontal groove the upper side of which is open, and said groove having a bottom portion extending in the direction in which the corresponding stringer extends and a pair of upstanding side wall portions on both sides, respectively, of said bottom portion, the bottom portion of said groove in said stringer retainer having a projection;

the bottom portion of said stringer having a bore, so that said projection on said stringer retainer is fitted into said bore in said stringer when installed; and said fastening means having a panel holder receiving member attached to the upper end of each of said column members and a panel holder brought into contact with a floor panel, said panel holder being detachably engaged with said panel holder receiving member, thereby passing said floor panel toward said panel holder receiving member and thus securing said floor panel.

7. A free access floor according to claim 6, wherein said stringer retainer has four grooves which extend radially at angular spacings of 90 degrees.

8. A free access floor according to claim 6, wherein said stringer is formed by pressing a steel plate, said stringer being firmly connected to said stringer retainer by means of a nut and bolt.

9. A free access floor according to claim 6, wherein said stringer is formed by pressing a steel plate, said stringer having a bottom portion, a pair of side wall portions upstanding on both sides, respectively, of said bottom portion, a horizontal edge portion continuous with each of said side wall portions and an end edge portion continuous with each of said horizontal edge portions.

10. A free access floor according to claim 6, wherein said panel holder receiving member is provided with an engagement hole which opens upward, said engagement hole having a slope formed on the inner wall thereof, said panel holder having a projecting portion which is detachably engaged with said slope.

11. A free access floor according to claim 6, wherein said fastening means comprises a panel holder receiving member attached to the upper end of each of said column members, a panel holder brought into contact with a floor panel and a bolt for fastening said panel holder to said panel holder receiving member.

* * * * *